US005617188A

United States Patent [19]

Inomata

[11] Patent Number: 5,617,188

[45] Date of Patent: Apr. 1, 1997

[54] DEVELOPING APPARATUS PROVIDED WITH A PORTABLE DEVELOPING UNIT FOR SUPPORTING A PLURALITY OF DEVELOPING DEVICES

[75] Inventor: Mitsugu Inomata, Kawasaki, Japan

[73] Assignee: Canon Kabushiki Kaisha, Tokyo, Japan

[21] Appl. No.: 551,575

[22] Filed: Nov. 1, 1995

Related U.S. Application Data

[63] Continuation of Ser. No. 198,509, Feb. 18, 1994, abandoned.

[30] Foreign Application Priority Data

Feb. 24, 1993 [JP] Japan ..... 5-059749
Apr. 30, 1993 [JP] Japan ..... 5-124742

[51] Int. Cl.[6] ..... G03G 15/00

[52] U.S. Cl. ..... 399/13; 118/691; 399/30; 399/119

[58] Field of Search ..... 355/260, 208, 355/245, 200, 246, 326 R, 327, 328, 203–9; 118/688, 689, 691

[56] References Cited

U.S. PATENT DOCUMENTS

| | | | |
|---|---|---|---|
| 4,593,991 | 6/1986 | Aoki et al. | 355/245 X |
| 4,620,783 | 11/1986 | Tanaka et al. | 355/206 |
| 4,646,679 | 3/1987 | Ohno et al. | 118/691 |
| 4,697,915 | 10/1987 | Hayashi et al. | 355/245 X |
| 4,743,938 | 5/1988 | Ohno | 118/645 X |
| 4,937,626 | 6/1990 | Kohtani et al. | 355/245 |
| 5,229,821 | 7/1993 | Fujii | 355/246 |
| 5,276,479 | 1/1994 | Inomata | 355/200 |

*Primary Examiner*—Thu A. Dang
*Attorney, Agent, or Firm*—Robin, Blecker, Daley & Driscoll

[57] ABSTRACT

A developing apparatus has a rotatable developing unit having a plurality of developing devices each provided with a containing portion for containing a developer and a carrying member carrying the developer, a light emitting element for applying light toward the containing portion, and a light receiving element provided discretely from the developing unit and common to the plurality of developing devices and for receiving the light transmitted through the containing portion.

9 Claims, 19 Drawing Sheets

CHECK MODE FOR PRESENCE OR ABSENCE OF DEVELOPMENT CRG

DEVELOPING APPARATUS PROVIDED WITH A PORTABLE DEVELOPING UNIT FOR SUPPORTING A PLURALITY OF DEVELOPING DEVICES

This is a continuation application under 37 CFR 1.62 of prior application Ser. No. 08/198,509, filed Feb. 18, 1994, now abandoned.

BACKGROUND OF THE INVENTION

1. Field of the Invention

This invention relates to a developing apparatus suitable for use in an image forming apparatus such as a copying apparatus or a printer, and particularly in a full color image forming apparatus, and having a plurality of developing devices.

2. Related Background Art

In a full color image forming apparatus of the electrostatic recording type or the electrophotographic type, it is practised to contain yellow toner, magenta toner, cyan toner and further, black toner in individual developing devices, superpose the developed image by the respective developing devices one upon another and fixate the developed image in mixed colors en bloc.

It is also practised to support these developing devices on a rotatable developing unit, rotate this developing unit and switch the developing devices opposed to an image bearing member.

In each of such developing devices, provision is made of a developing sleeve, a particular gap and an antenna member for detecting the quantity of remaining developer, and the quantity of remaining developer is detected by a variation in the electric capacity between the developing sleeve and the antenna member.

However, if the antenna member is thus provided in the developing device, it will become necessary to provide wiring from the antenna to the apparatus body through the developing unit, and a special slidable contact for detecting the remaining quantity and the wiring itself will become long.

Therefore, the S/N ratio cannot be made great and accurate detection of the remaining quantity will be difficult to accomplish.

Also, the connecting portion between each developing device and a developer supply portion therefor is separated and connected to switch the developing device for developing a latent image on the image bearing member. Therefore, leakage of the developer occurs. Also, to replace the developing device whose life has expired, it has been necessary for a worker having special knowledge to use a special tool to replace or maintain the developing device.

SUMMARY OF THE INVENTION

It is an object of the present invention to provide a developing apparatus which eliminates the provision of a special slidable contact for detecting the quantity of remaining developer.

It is another object of the present invention to provide a developing apparatus in which a plurality of developing devices are supported as removable cartridges on a rotatable developing unit.

It is still another object of the present invention to provide a developing apparatus having a rotatable developing unit having a plurality of developing devices each provided with a containing portion for containing a developer therein and a carrying member for carrying the developer thereon, a light emitting element for applying light toward said containing portion, and a light receiving element provided discretely from said developing unit and common to said plurality of developing devices and for receiving the light transmitted through said containing portion.

It is yet another object of the present invention to provide a developing apparatus having a rotatable developing unit for removably supporting a plurality of developing cartridges, and mounting detecting means for detecting the presence or absence of the mounting of said developing cartridges at a predetermined detecting position, said mounting detecting means being capable of detecting the presence or absence of the mounting of said plurality of developing cartridges by the rotation of said developing unit relative to said detecting position.

Further objects of the present invention will become apparent from the following description.

DETAILED DESCRIPTION OF THE PREFERRED EMBODIMENTS

Some embodiments of the present invention will hereinafter be described.

[Embodiment 1]

Figure 1:
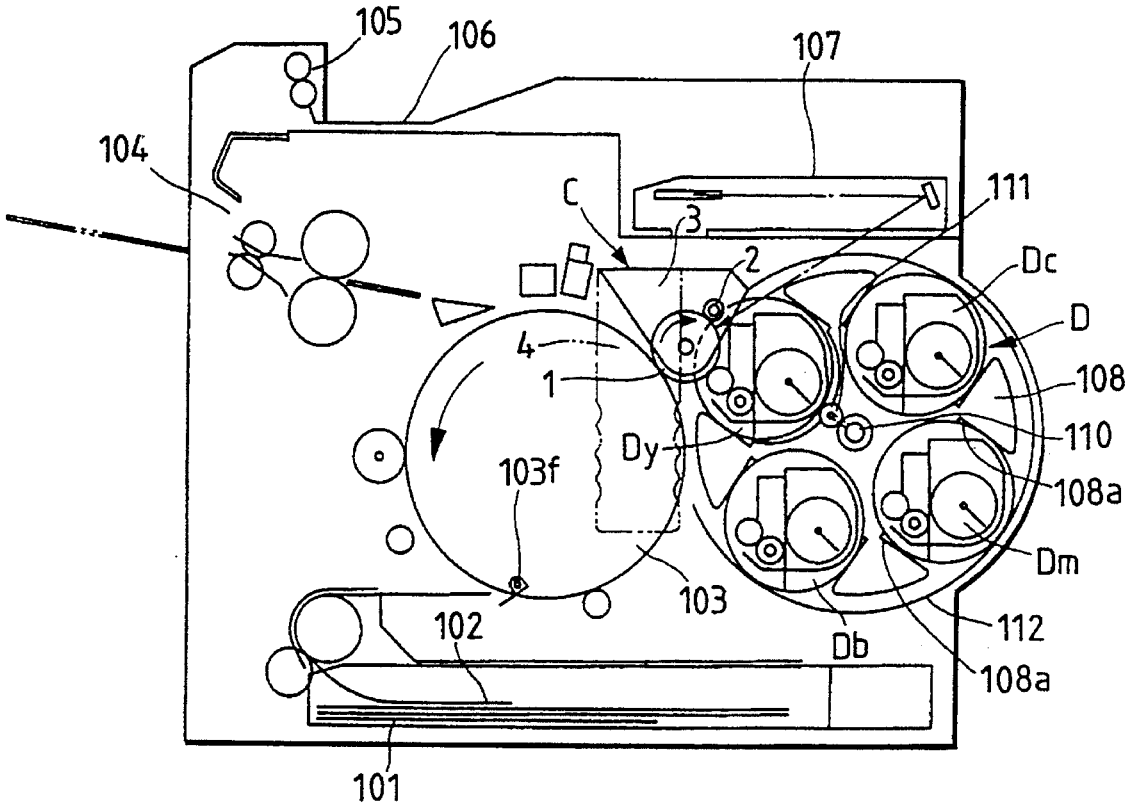
FIG. 1 shows the general construction of an embodiment of the image forming apparatus of the present invention.

FIG. 1 is a cross-sectional view of an image forming apparatus using a developing apparatus according to an embodiment of the present invention. This image forming apparatus has a drum cartridge C comprising a charging member 2 and a cleaner 3 integrally made into a cartridge on a photosensitive drum 1 which is an image bearing member and removably mountable in the apparatus body, developing cartridges D of various colors (i.e., a yellow developing cartridge Dy, a magenta developing cartridge Dm, a cyan developing cartridge Dc and a black developing cartridge Db) each comprising a developing portion provided with a developer carrying member and a toner containing portion containing therein a toner which is a one-component developer, the developing portion and the toner containing portion being integrally made into a cartridge, the developing cartridges D being independently removably mountable in the apparatus body, a rotatable developing unit having the developing cartridges D of various colors removably mounted thereon, and a developing cartridge switching mechanism for rotating the developing unit so that a selected developing cartridge for developing an electrostatic latent image on the image bearing member 1 may be opposed to the image bearing member 1.

According to this image forming apparatus, a latent image for each color is formed on the image bearing member 1 of the drum cartridge (by the image exposure from an optical unit 107, and by the switching mechanism). Switching is effected to a developing cartridge D of a color conforming to the latent image, whereby the latent image is developed. The toner images of respective colors thus obtained by the development of the respective colors are successively superposed one upon another and transferred onto paper 102 held on a transfer drum 103. The paper 102 is supplied from a paper supply portion 101, and is held on the outer periphery of the transfer drum 103 by the rotation thereof with the leading end of the paper gripped by the gripper 103*f* of the transfer drum 103. The paper 102 to which the toner images have been transferred is separated from the transfer drum 103 and is sent to a fixating unit 104, by which the toner images on the paper are mixed and fixated, whereafter the paper is discharged onto a paper discharge tray 106 via a paper discharge portion 105.

Figure 2:
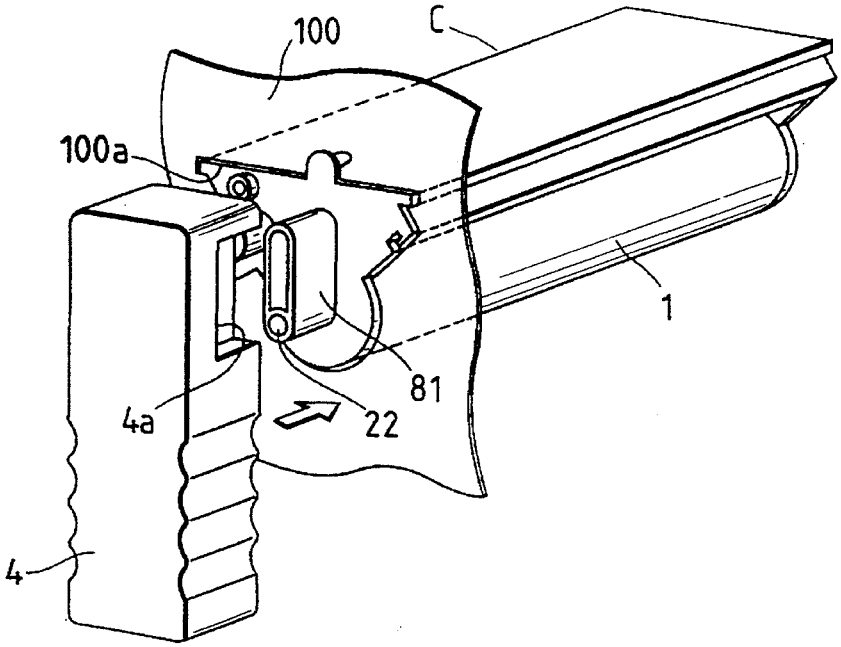
FIG. 2 is a perspective view showing a method of mounting a drum cartridge and a waste toner container provided in the image forming apparatus of FIG. 1.

The drum cartridge C will now be described with reference to FIGS. 2 to 6. The drum cartridge C, as shown in FIG. 2, is inserted into a mounting port 100*a* formed in a pair of side plates 100 (of which only the front side is shown) in the image forming apparatus body, in a thrust direction (a direction perpendicular to the plane of the side plate 100) from outside of the front side plate 100, and is mounted between the side plates 100, and thus the drum cartridge C is removably provided in the apparatus body in the thrust direction.

A waste toner container 4 is attached to one side exposed from the side plate 100 of the drum cartridge C, and the upper portion of the waste toner container 4 has a cut-away portion 4*a* of a shape fit for a cover 81 covering the exposed center shaft 1*a* of the image bearing member 1. The cut-away portion 4*a* and the cover 81 serve as a guide when the waste toner container 4 is to be mounted onto the drum cartridge C.

An entrance and exit, not shown, for permitting the ingress and egress of the drum cartridge C and the waste toner container 4 into and out of the apparatus body is provided at a corresponding location in an unshown outer plate on the front side of the apparatus body (the front in the plane of the drawing sheet of FIG. 1).

Figure 3:
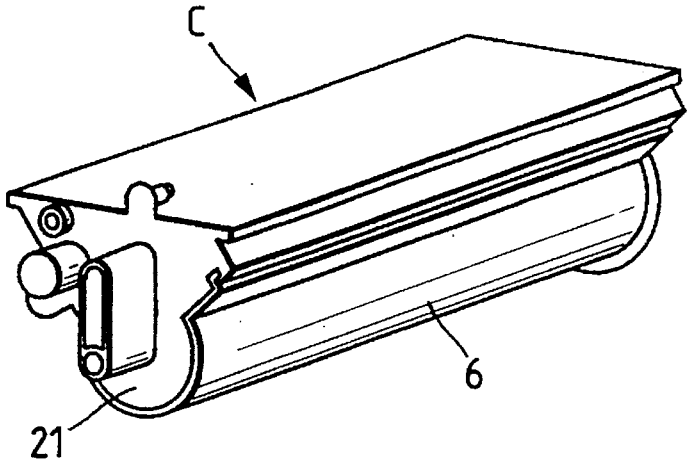
FIG. 3 is a perspective view showing the state of the drum cartridge before mounting.
Figure 5:
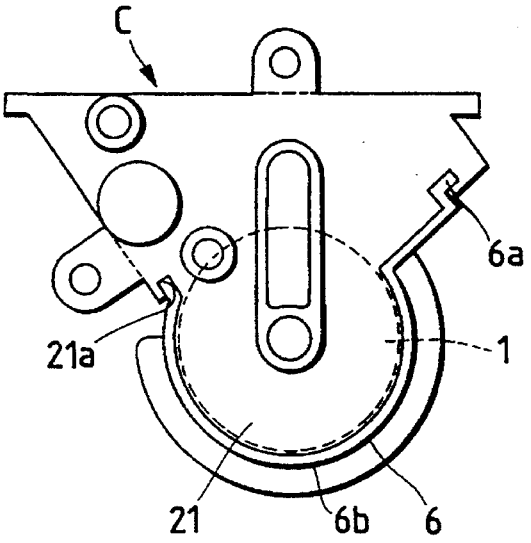
FIG. 5 is a front view showing the state of the drum cartridge before mounting as it is seen in the axial direction thereof.

This drum cartridge C, as shown in FIGS. 3 and 5, has plate-like frame portions 21 at the opposite ends thereof, and the aforementioned cylindrical image bearing member 1 is rotatably mounted between the lower portions of the frame portions 21.

Figure 4:
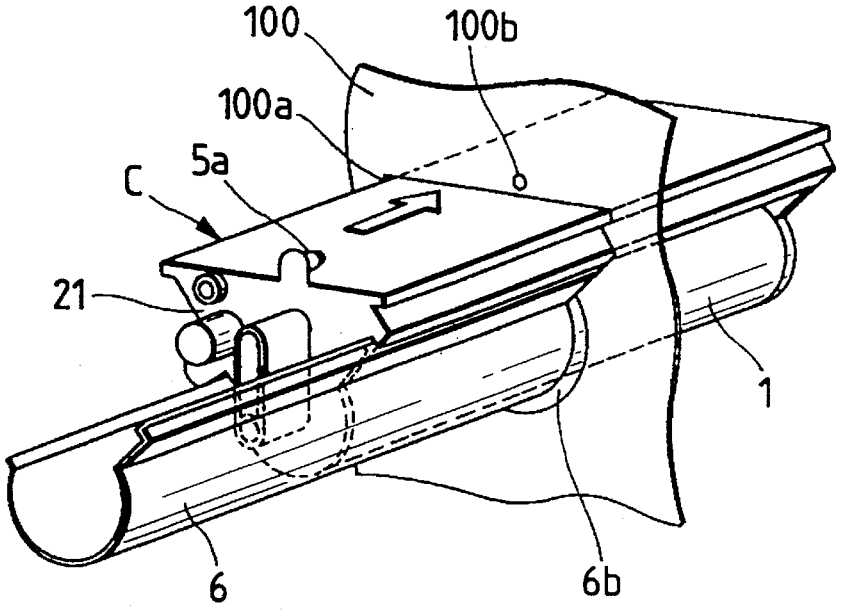
FIG. 4 is a perspective view showing a protecting member as it comes off during the mounting of the drum cartridge.

The drum cartridge C, before mounting in the apparatus body, has more than half of the peripheral area of its lower half which is exposed externally of the image bearing member 1 covered with and protected by a protecting member 6. The protecting member 6 is of a substantially semicylindrical shape having an open upper surface, and is attached to the drum cartridge C in the lengthwise direction thereof by projected portions 6*a* which extend from the opposite ends of the opening in the semicylinder being inserted into cut-away grooves 21*a* formed near the centers of the opposite ends of the frame portion 21 of the drum cartridge C. When the drum cartridge C is inserted into the mounting port 100*a* in the side plate 100 during the mounting of the drum cartridge C onto the side plate 100, a frame portion 6*b* provided on the forward end portion of the projecting member 6 as viewed in the direction of insertion thereof strikes against the side plate 100, as shown in FIG. 4, and the protecting member 6 comes off the drum cartridge C.

Figure 6:
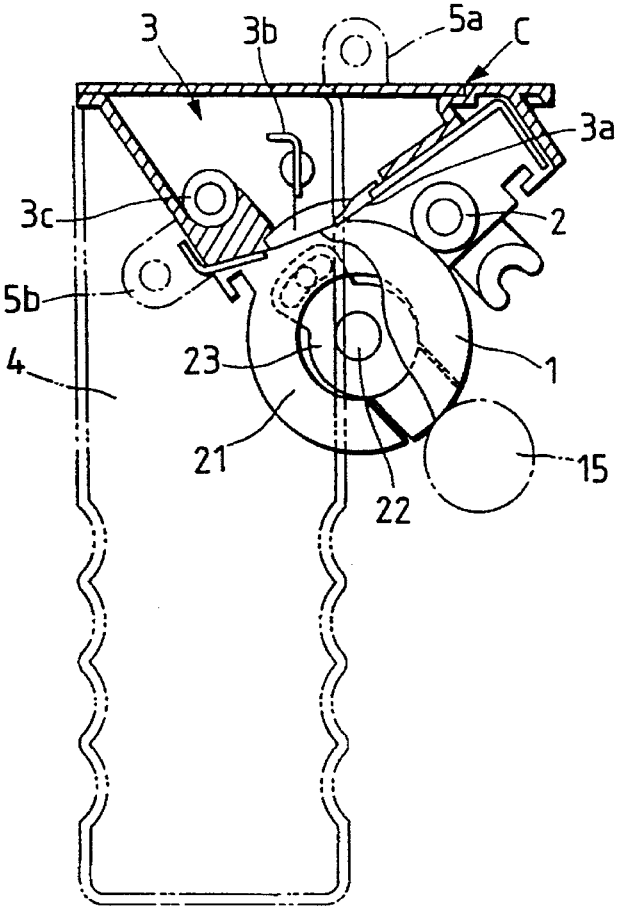
FIG. 6 is a cross-sectional view showing an eccentric member as it is provided on the central shaft of an image bearing member installed in the drum cartridge.

The drum cartridge C, as shown in FIG. 6 (in which the frame portion 21 on this side is shown to be stripped off), is provided with the image bearing member 1, the charging member 2 therefor, the cleaner 3, i.e., a cleaning member 3*a*, for the image bearing member 1, an agitating member 3*b* for removed toner, and a toner feeding screw 3*c* to the waste toner container 4. It further has positioning members 5*a* and 5*b* with respect to the side plates 100 of the drum cartridge C, on the frame portion 21 adjacent to the waste toner container 4 side (this side).

The above-described developing cartridge switching mechanism, as shown in FIG. 1, comprises a pair of plate-like developing cartridge holding members 108 rotatable about a non-rotatable center shaft 110 parallel to the axis of the image bearing member 1, a pressing member 111 for pressing a developing cartridge D selected at the developing position toward the image bearing member 1 of the drum cartridge C, a control mechanism for maintaining the developing cartridges D in a predetermined posture, etc.

Figure 7:
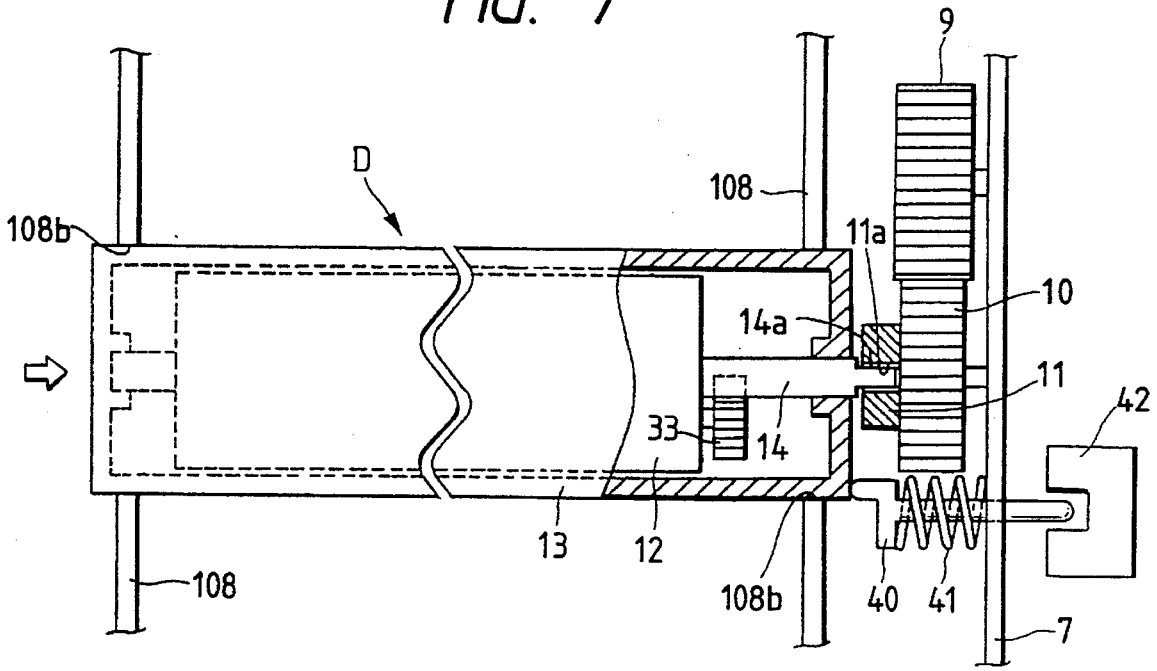
FIG. 7 is a partly broken-away side view showing a method whereby a switching mechanism for a developing cartridge provided in the image forming apparatus of FIG. 1 is mounted on a holding member.

Each of the holding members 108 is of a four-leafed clover shape, and is formed with containing apertures 108*b* at four locations along the circumferential direction thereof, each of the containing apertures 108*b* comprising a substantially semicircular cut-away portion for containing the developing cartridge D. The developing cartridge D of each color, while being guided by a guide member 112, is contained in the containing apertures 108*b* of the pair of holding members 108 and mounted between the holding members 108, as shown in FIG. 7, at location other than the developing position opposed to the image bearing member 1, and conversely the developing cartridge D is removed from the holding members 108. Thus, the developing cartridge D of each color is independently removably mountable in the thrust direction thereof with respect to the switching mechanism, i.e., removably mountable with respect to the apparatus body. An entrance and exit, not shown, for each developing cartridge D is provided at a predetermined location in an outer plate, not shown, on the front side of the apparatus body (the front in the plane of the drawing sheet of FIG. 1).

Figure 8:
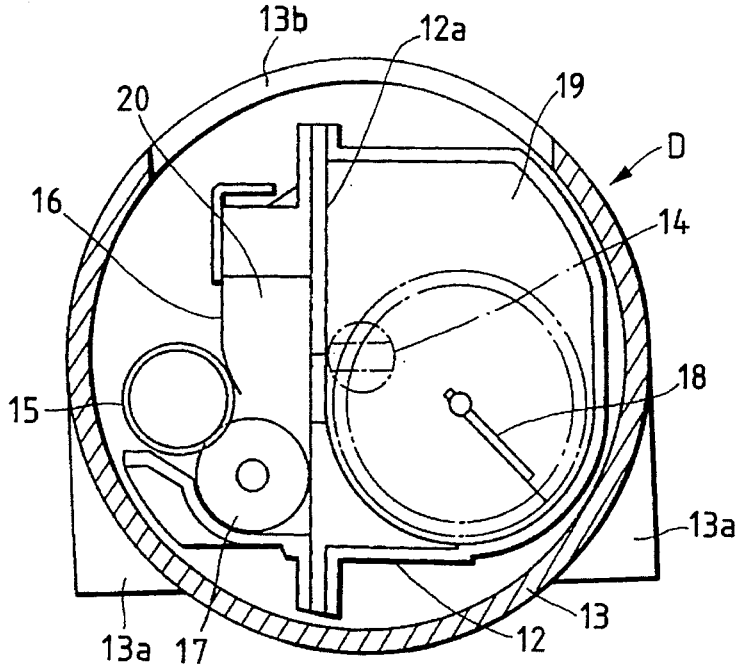
FIG. 8 is a cross-sectional view of the developing cartridge of FIG. 7.
Figure 9:
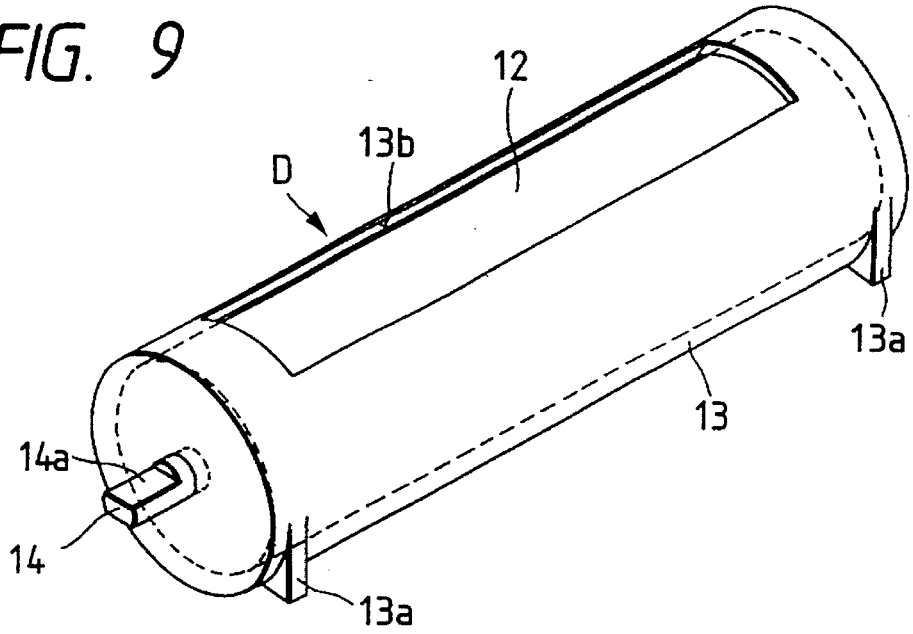
FIG. 9 is a perspective view of the developing cartridge.

Each developing cartridge D, as shown in FIGS. 8 and 9, comprises a developing device 12, and a cylindrical support container 13 rotatably containing the developing device 12 through a rotary support shaft 14 fixed to the opposite ends of the developing device. The rotary support shaft 14 on the inner side of the apparatus extends through the end surface of the developing device 12 and is mounted on a control mechanism for the developing cartridge switching mechanism which will be described later.

The developing device 12 broadly comprises a toner containing portion 19 and a developing portion 20 adjacent thereto. An agitating-conveying member 18 for agitating the toner and conveying it to the developing portion 20 is provided in the toner containing portion 19. In the developing portion 20, there are provided a developer carrying member 15, a supplying-stripping member 17 for supplying the toner to the developer carrying member and stripping off undeveloped toner thereon, and a regulating member 16 for regulating the layer thickness of the toner carried on the developer carrying member 15 and imparting charges.

On the opposite end portions of the support container 13, there are provided legs 13*a* corresponding to stepped portions 108*a* provided in the containing apertures 108*b* of the holding members 108 shown in FIG. 1, and by the legs 13*a* bearing against the stepped portions 108*a*, the support container 13 contained in the containing apertures 108*b* is held against rotation relative to the holding members 108. The legs 13*a* serve also as a guide for moving the developing cartridge D toward the image bearing member 1 when the developing cartridge D is to be positioned in the developing position.

Each developing cartridge D is contained and mounted in the containing apertures 108*b* of the holding members 108 with the developing device 12 brought into a predetermined posture, in the present embodiment, a horizontal posture in which the toner containing portion 19 and the developing portion 20 are laterally adjacent to each other (a posture in which a wall 12*a* partitioning the toner containing portion 19 and the developing portion 20 is vertical), i.e., with the parallel portions 14*a* of the rotary support shaft 14 brought into a horizontal posture.

The developing cartridge switching mechanism, as shown in FIG. 1, is provided with a control mechanism for invariably maintaining the developing device 12 of each developing cartridge D moved to the developing position by the rotation of the holding members 108 in a predetermined posture.

Figure 10:
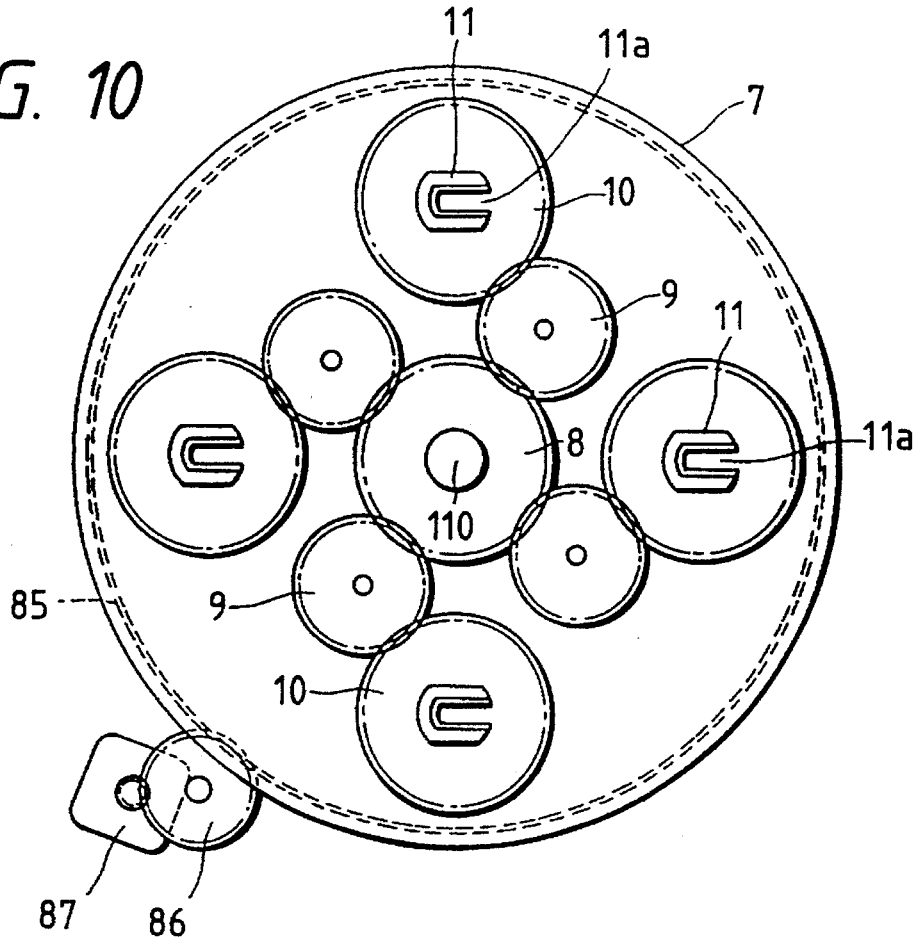
FIG. 10 is a front view of a planet gear mechanism for the control mechanism of the switching mechanism.

The control mechanism of the switching mechanism, as shown in FIGS. 7 and 10, has a disc-like developing device driving mechanism supporting side plate 7 rotatable about the non-rotatable center shaft 110 of the holding members 108 with the holding members 108, and on the inner side of the supporting side plate 7, mutually meshing gears 9 and 10 constituting the driving mechanism of the developing device 12 are provided correspondingly to the respective developing cartridges D, and further a gear 8 meshing with each gear 10 is unrotatably installed on the center shaft 110, and a planet gear mechanism is constituted by these gears 8, 9 and 10. A concave member 11 having a groove 11*a* opening at one end thereof is mounted on that side of each gear 10 which is adjacent to the developing cartridge D, and in the present embodiment, with the groove 11*a* of the concave member 11 rendered horizontal, the rotary support shaft 14 of the developing device 12 of the developing cartridge D mounted on the holding members 108 is fitted in the groove 11*a* with the parallel portions 14*a* thereof rendered horizontal.

Figure 11:
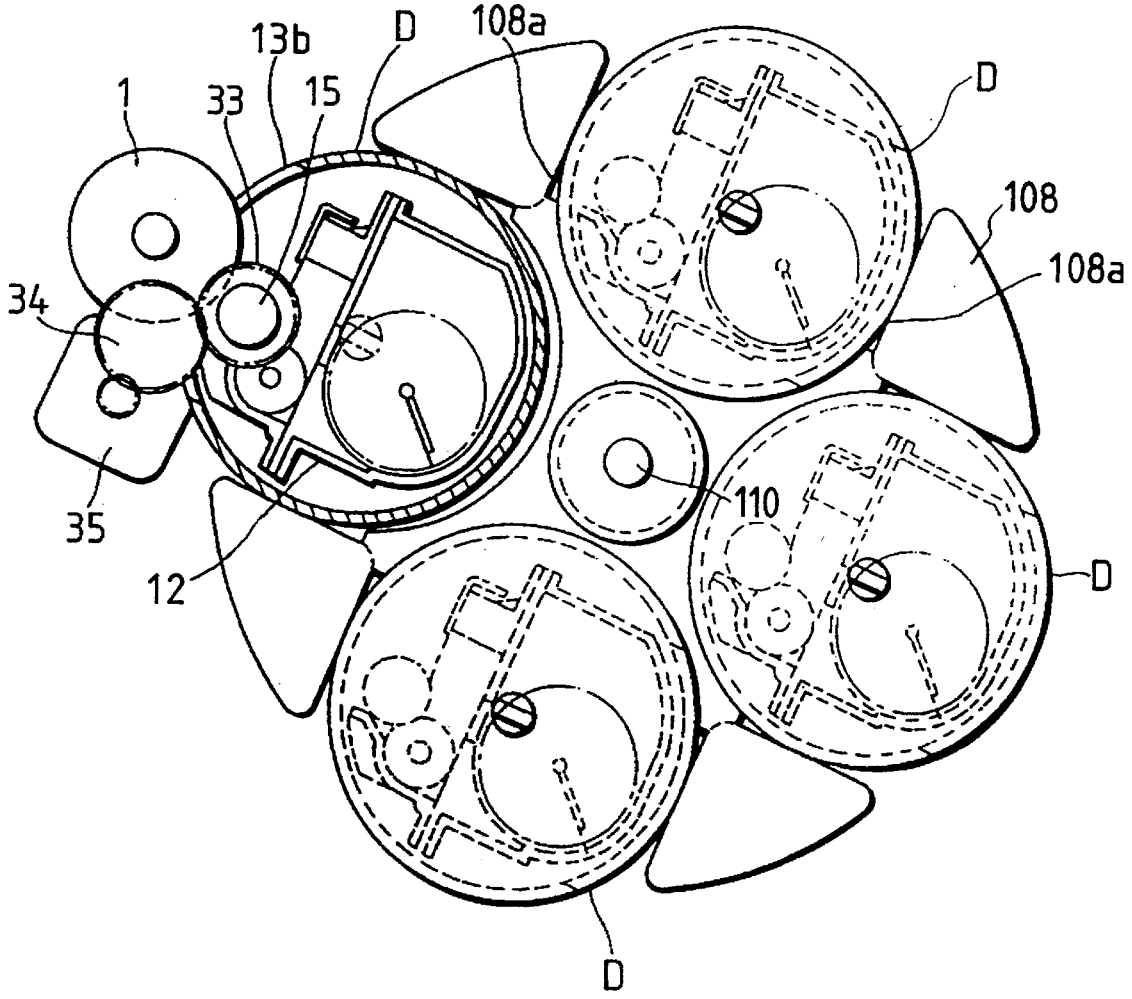
FIG. 11 is a front view showing a posture of the developing device in the developing cartridge.

As required, a drive source, not shown, may be installed for the center shafts 110 of the holding members 108, and when the center shafts 110 are rotated, the developing device 12 of each developing cartridge D can be brought into any posture such as an inclined posture shown in FIG. 11.

When as shown in FIG. 11, the developing cartridge D is moved to the developing position opposed to the image bearing member 1 and is positioned in a posture inclined toward the toner containing portion 19 of the developing device 12, a gear 34 on the apparatus body side is connected to a gear 33 provided on the developer carrying member 15 in the developing device 12, through the opening portion 21*b* of the support container 21 of the developing device 12, whereby the gear 34 is driven by a drive source 35 on the apparatus body side.

Now, according to the present embodiment, as shown in FIG. 7, a bar-like detecting member 40 for detecting the presence or absence of the mounting of each developing cartridge D is installed correspondingly to the mounted position of the developing cartridge D. The detecting member 40 is disposed so as to extend through the supporting side plate 7, and is biased by a spring 41 provided on the supporting side plate 7 and is protruded toward the developing cartridge D. When the developing cartridge D is mounted in the holding members 108 of the switching mechanism, the detecting member 40 is pushed by the developing cartridge D and the other end thereof protrudes in the opposite direction from the supporting side plate 7.

Figure 12:
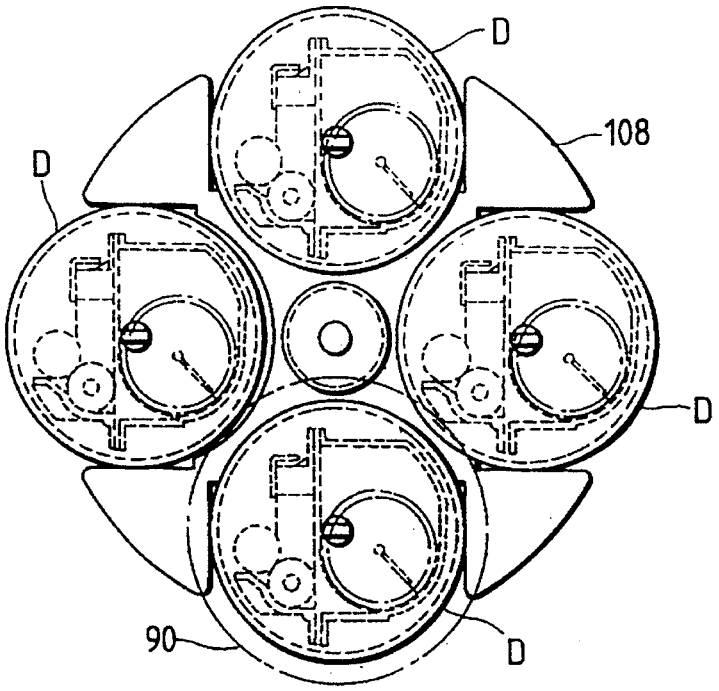
FIG. 12 is a front view showing an intercharge port of the developing cartridge.
Figure 13:
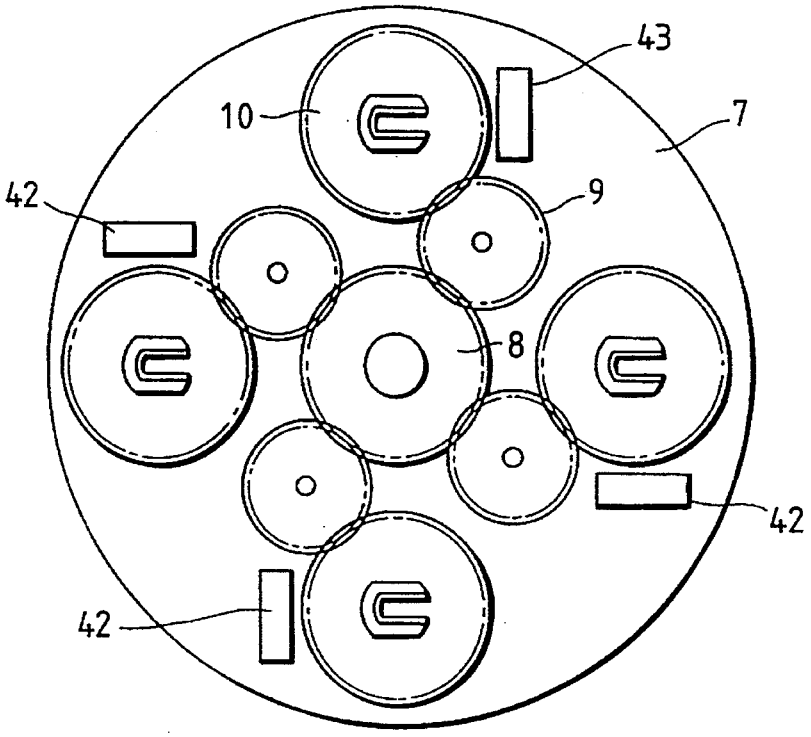
FIG. 13 is a front view showing a detecting sensor in the planet gear mechanism.

As shown in FIG. 12, an interchange port 90 for the developing cartridge D is formed in the side plate of the apparatus body, and as shown in FIGS. 7 and 13, a detecting sensor 42 is installed correspondingly to the location of the detecting member 40 when the developing cartridge D is positioned in the interchange port 90, so as to detect the detecting member 40 protruded from the supporting side plate 7.

Thus, in the present embodiment, the presence or absence of the mounting of each developing cartridge D onto the switching mechanism can be detecting during the interchange of the developing cartridge D.

[Embodiment 2]

Figure 14:
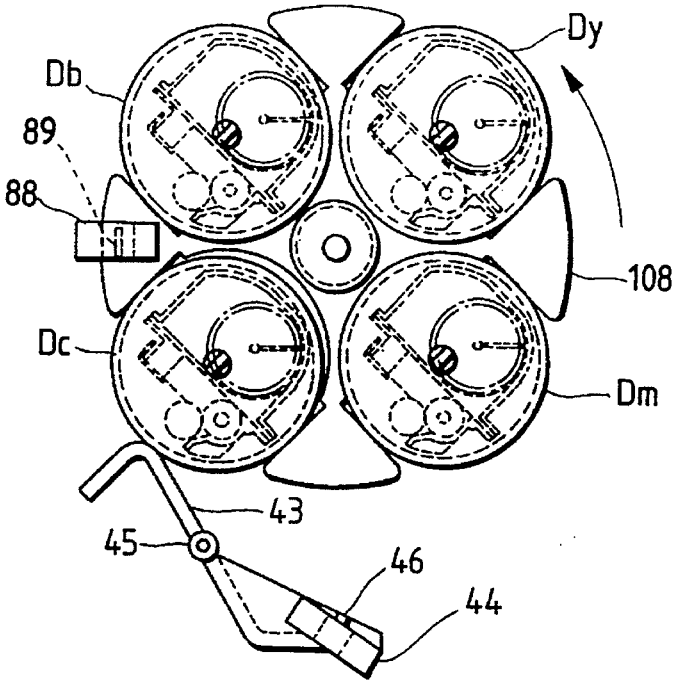
FIG. 14 is a front view showing a detecting lever and a revolution position sensor for the developing cartridge.

A second embodiment of the present invention will now be described with reference to FIGS. 14 to 17. In this embodiment, as shown in FIG. 14, a detecting lever 43 constituting detecting means for detecting the presence or absence of the mounting of the developing cartridge D is provided on the apparatus body for pivotal movement about a fulcrum 45, and a flag 46 is provided on the other end of the lever 43. Also, a detecting sensor 44 is provided on the apparatus body near the other end of the lever 43.

Figure 15:
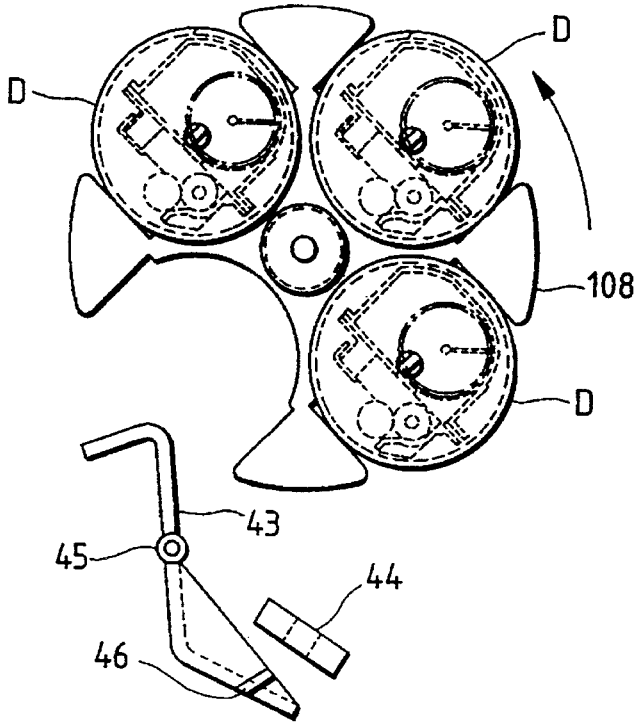
FIG. 15 is a front view which is the same as FIG. 14, showing the detecting the lever when the developing cartridge is not mounted.

When the developing cartridge D comes to the location of the detecting lever 43 by the rotation by the switching mechanism, the lever 43 is pushed and pivotally moved by the developing cartridge D and the flag 46 on the other end of the lever 43 interrupts the sensor 44, whereby the mounting of the developing cartridge D is detected. If the developing cartridge D is not mounted, the lever 43 will be in a state in which the other end thereof is lowered by gravity, as shown in FIG. 15, and the flag 46 will not interrupt the sensor 44.

Also, as shown in FIG. 14, a revolution position flag 89 is provided on the holding member 108, and corresponding thereto, a revolution position sensor 88 is provided on the apparatus body. The mounted position of which developing cartridge will pass the location of the detecting lever 43 in how many seconds after the revolution position sensor 88 has been turned on by the developing cartridge being rotated by a revolution mechanism (switching mechanism) is memorized in the ROM of a block diagram shown in FIG. 16. As shown in the flow chart of FIG. 17, the presence or absence of the mounting of the particular developing cartridge is detected by whether or not the detecting sensor 44 is turned on within that time. When the mounting of the developing cartridge (development CRG) is detected, a display LED is turned on and off to display it.

In the foregoing, the developing cartridge is mounted at a particular position in conformity with the color thereof. The information obtained by detecting the presence or absence of the mounting of the developing cartridge can be communicated to a host so that image formation possible in that mounted state may be effected.

[Embodiment 3]

Figure 16:
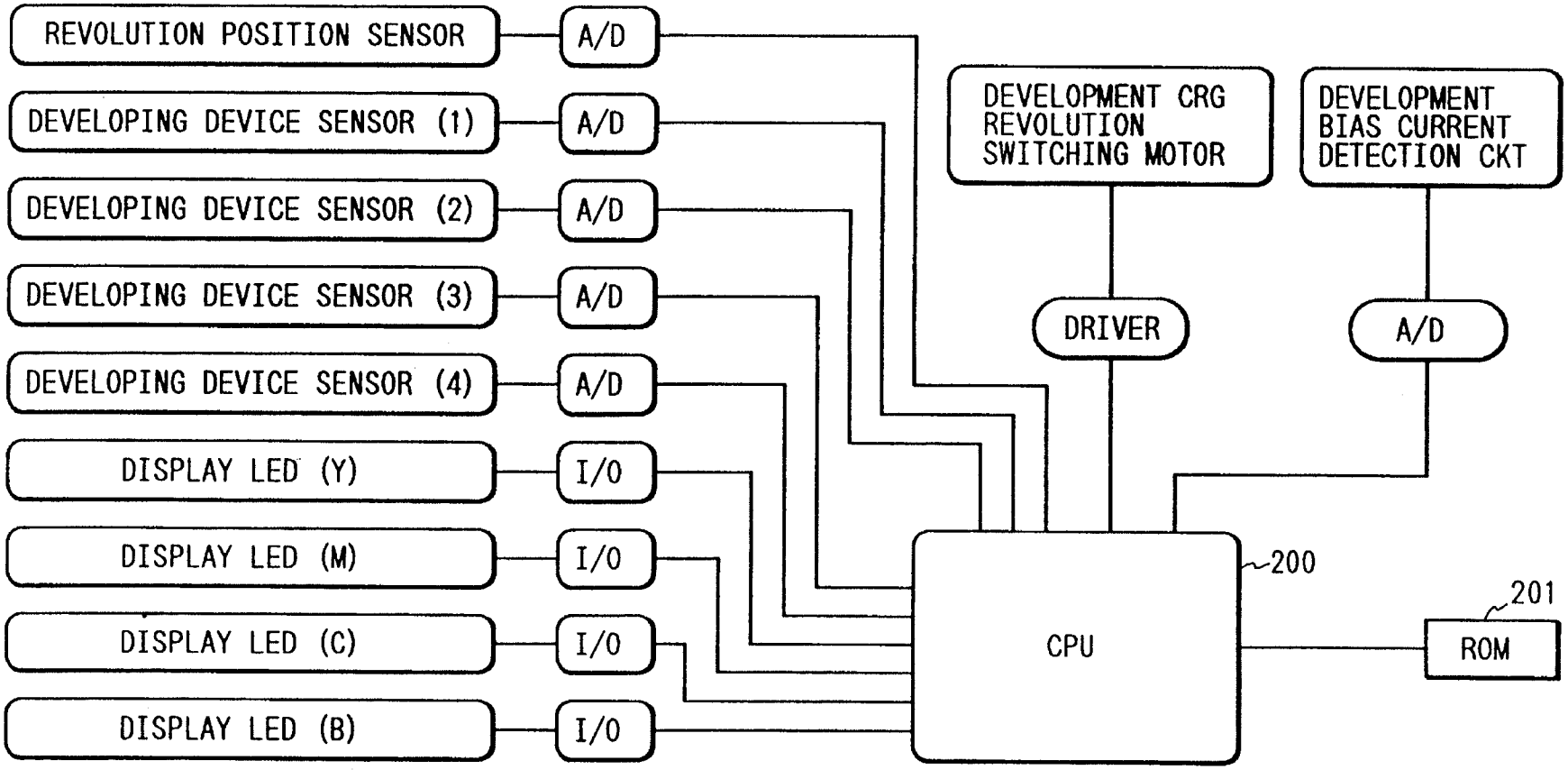
FIG. 16 is a block diagram showing a method of detecting the presence or absence of mounting.
Figure 17:
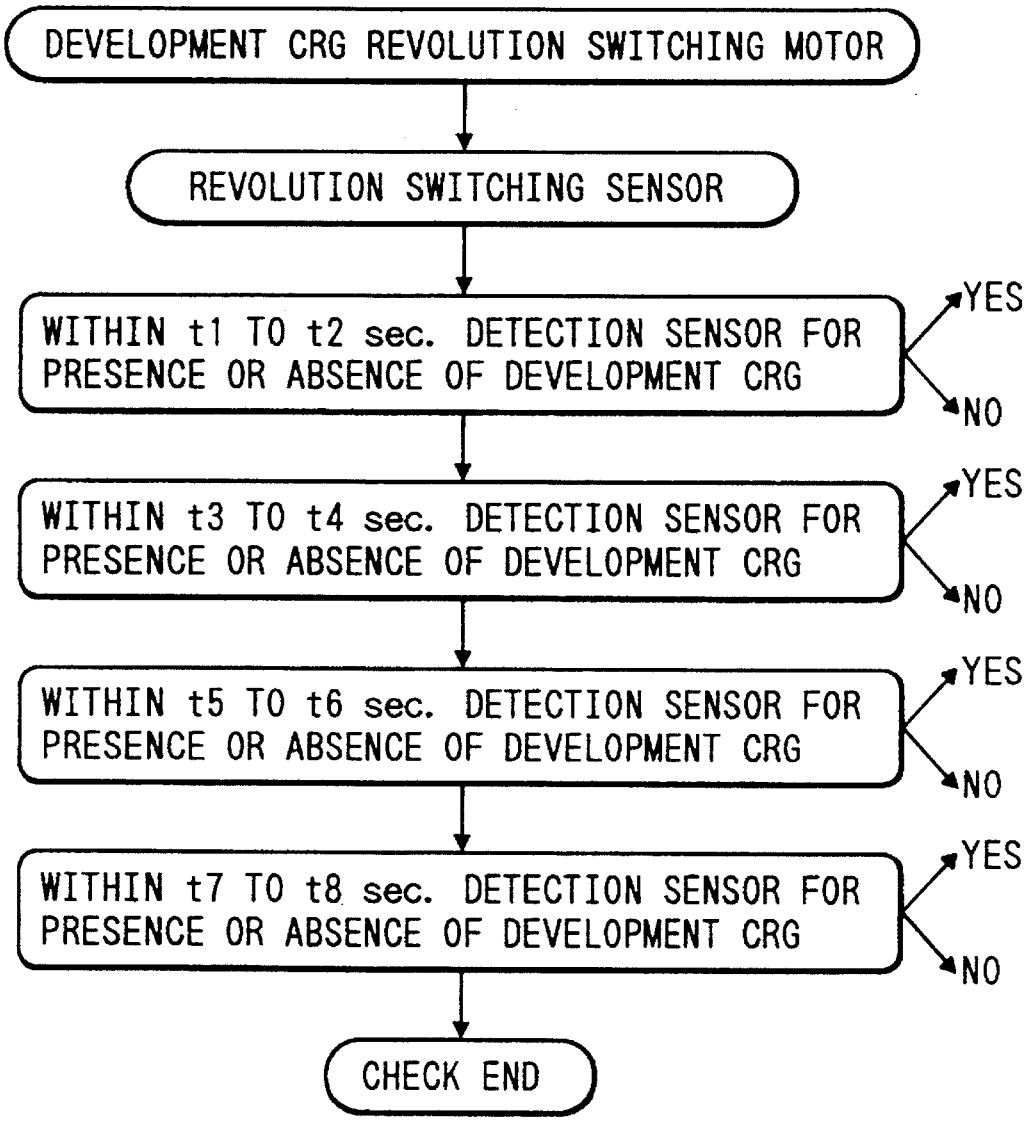
FIG. 17 is a flow chart of the control of the method of FIG. 16.
Figure 18:
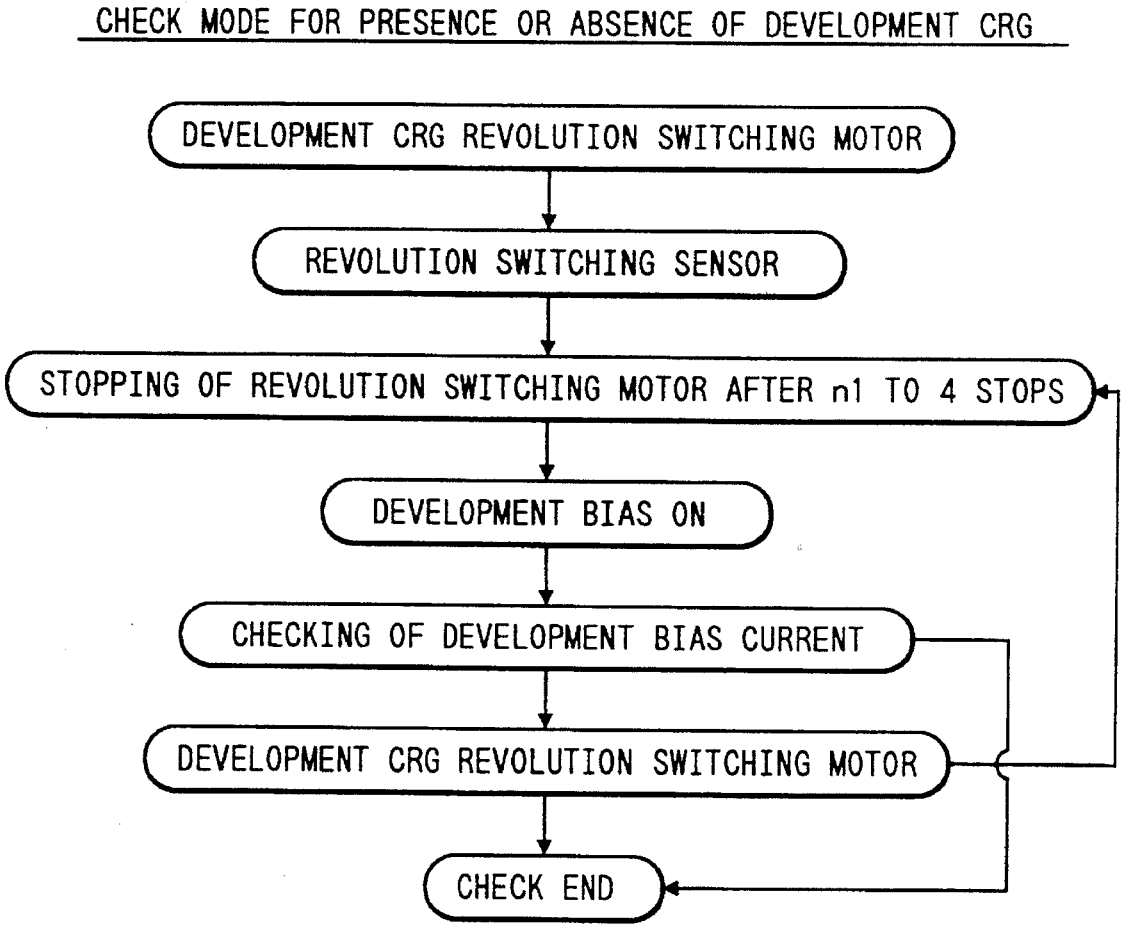
FIG. 18 is a flow chart showing a method of detecting the presence or absence of the mounting of a developing cartridge in another embodiment of the image forming apparatus of the present invention.

A third embodiment of the present invention will now be described. In this embodiment, as shown in FIG. 16, a development bias current detection circuit is provided between the image bearing member 1 and the developer carrying member 15 of the developing cartridge D, and as a check mode for the presence or absence of the developing cartridge (development CRG), each developing cartridge is selectively moved to the developing position, and development bias is applied to between the image bearing member and the developer carrying member. As shown in the flow chart of FIG. 18, the development bias current is checked up to thereby detect whether the developer carrying member 15 is opposed to the image bearing member 1, thus detecting the presence or absence of the mounting of the developing cartridge D.

Further, in the present embodiment, during the detecting operation, a developing cartridge revolution switching motor (the motor 87 of FIG. 10) is operated at a small speed as compared with the usual switching operation, whereby even if there is some unbalance in the mounting of the developing cartridge, there may be obtained the driving torque of the motor necessary therefor. Thus, the driving torque of the motor need not be secured excessively for the detecting operation.

[Embodiment 4]

Figure 19:
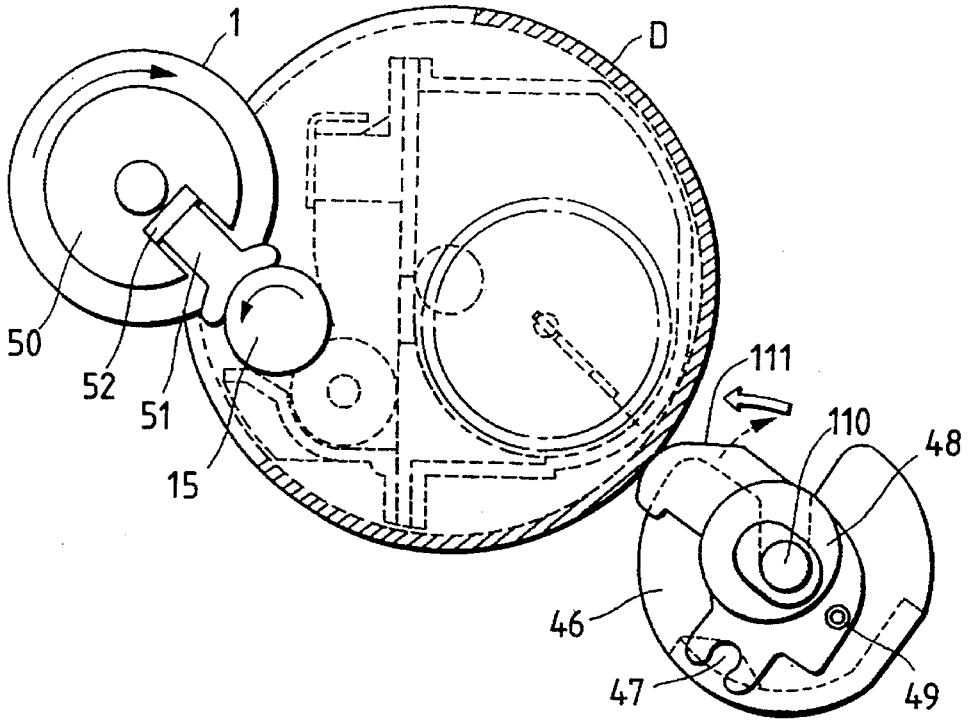
FIG. 19 is a front view showing a pressurizing method for the developing cartridge at the developing position in yet another embodiment of the image forming apparatus of the present invention.

In this embodiment, as shown in FIG. 19, a support member 46 is fixedly installed in the apparatus body, whereby the support member 46 is provided about the center shaft 110 of the developing cartridge switching mechanism, and on the shaft 47 of this support member 46, a pressing member 111 rotatable with the shaft 47 as a fulcrum is mounted, and through the pressing member 111, the developing cartridge D is pressed against the image bearing member 1 by an urging spring, not shown. A cam 48 is fixed to the center shaft 110, and the pressing and non-pressing of the developing cartridge by the pressing member 111 are controlled by the rotation stop position of the center shaft 110.

During the pressing, as shown, the cam 48 does not contact with a projection 49 provided on the pressing member 111, and the pressing member 111 causes the urging force by the urging spring, not shown, to act on the developing cartridge D. During the non-pressing, the cam 48 is rotated by the rotation of the center shaft 110 and comes into contact with the projection 49 to thereby rotate the pressing member 111 in the direction of dotted-line arrow in FIG. 19, thus spacing the developing cartridge D apart from the image bearing member 1 against the urging force of the urging spring.

The rotation of the center shaft 110 is effected by a pressing control motor, not shown, and the stopped position thereof is controlled by the signal of a cam sensor, not shown.

Holding members 50 are provided on the opposite ends of the image bearing member 1, and the holding members 50 each are provided with a dash member 51 adapted to bear against the outer periphery of the developer carrying member 15 of the developing cartridge D and maintain the gap between the developer carrying member 15 and the image bearing member 1. Also, as shown, a pressure sensor 52 is provided between the dash member 51 and the holding member 50. If the developing cartridge D is normally pressure-positioned relative to the image bearing member 1, predetermined or greater pressure will be detected by the sensor 52, whereby the opposed state of the image bearing member 1 and the developer carrying member 15 will be known.

If the image bearing member and the developer carrying member are not normally opposed to each other, the error of the opposing operation can be displayed or the pressing operation or the developing cartridge switching operation can be performed again.

[Embodiment 5]

Figure 20:
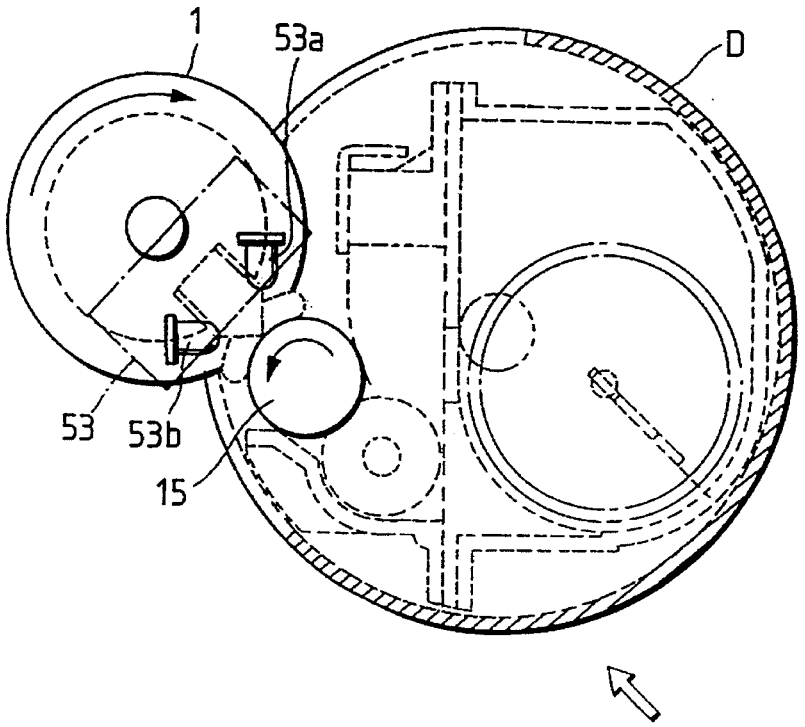
FIG. 20 is a front view showing a method of detecting the quantity of the opposition of the developer carrying member of the developing cartridge to an image bearing member by the pressurization at the developing position in a further embodiment of the image forming apparatus of the present invention.
Figure 21:
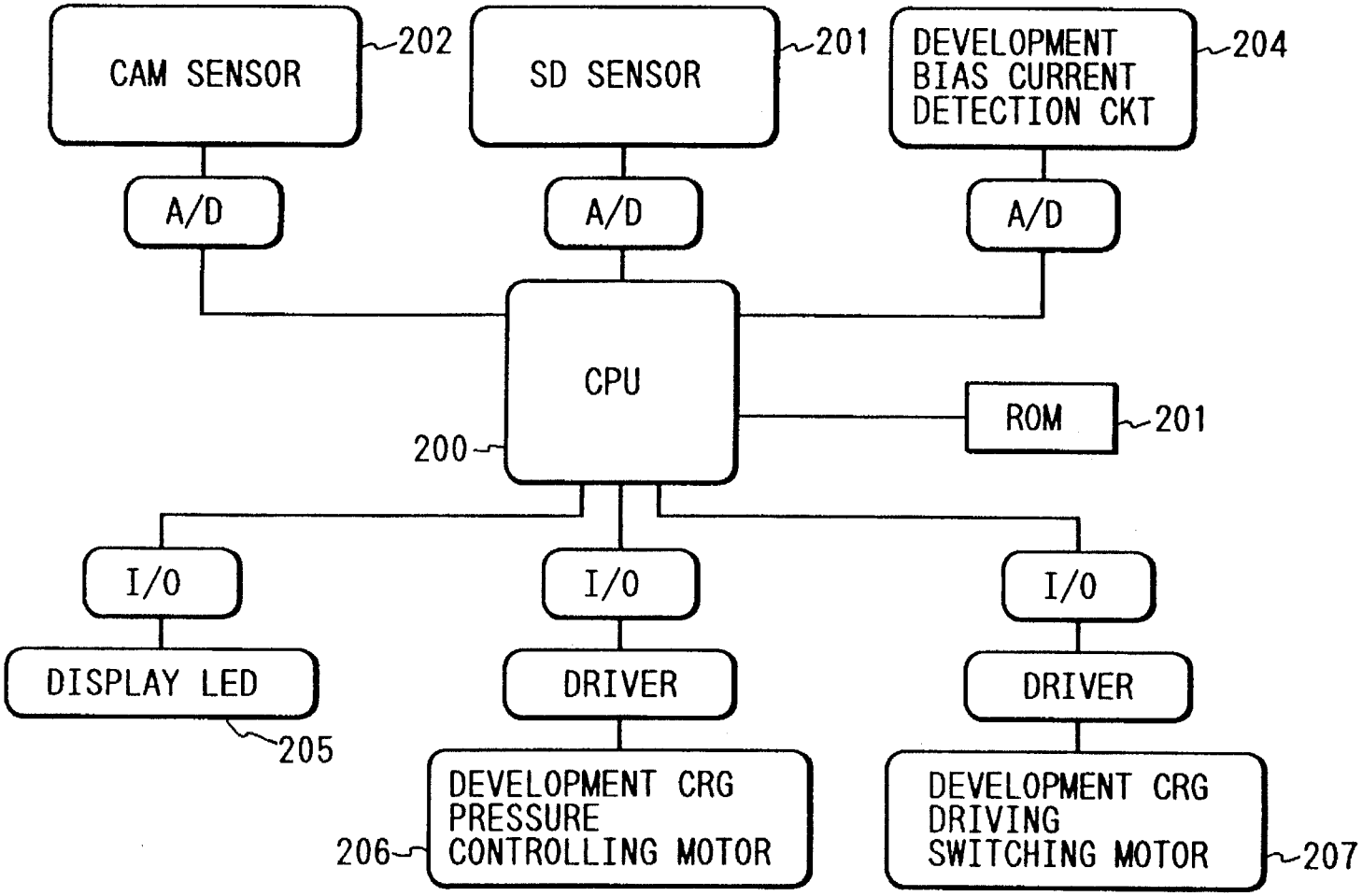
FIG. 21 is a block diagram for carrying out the detecting method of FIG. 20.
Figure 22:
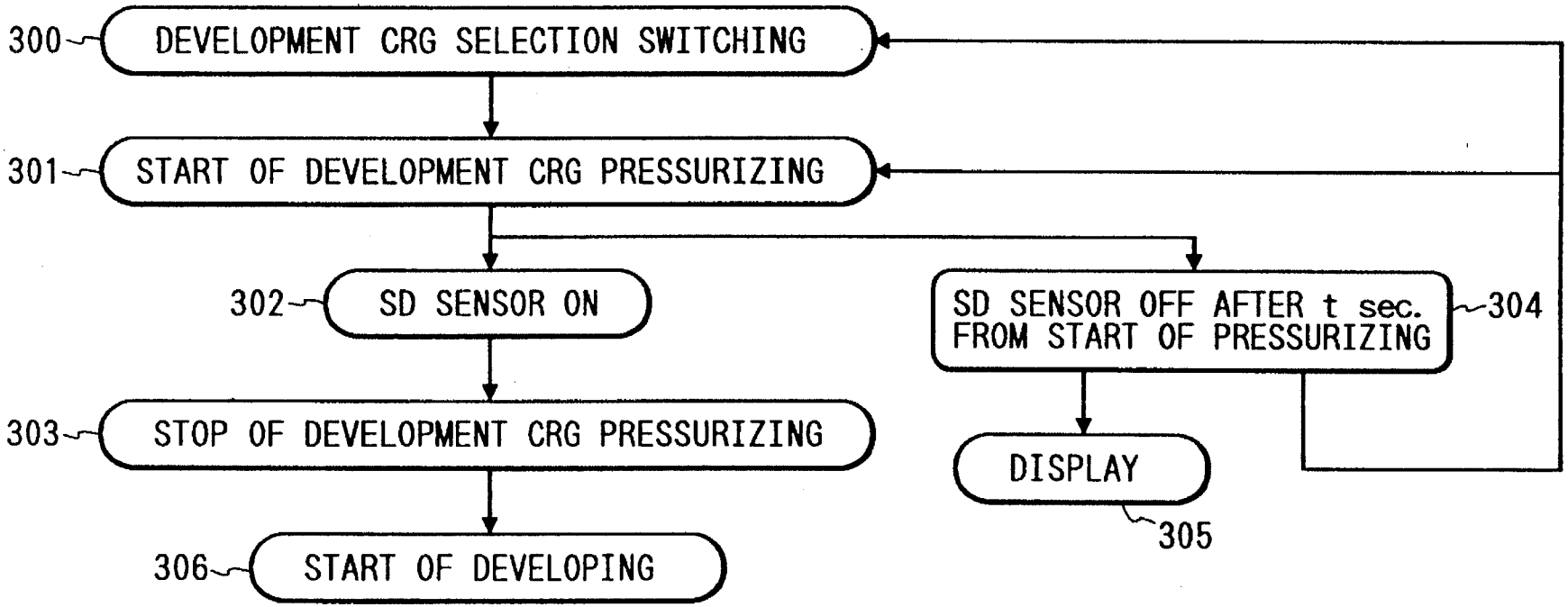
FIG. 22 is a flow chart when the detecting method is carried out.

FIGS. 20 to 22 show a fifth embodiment of the present invention. In this embodiment, SD sensors 53 each comprising a light reflecting type sensor provided with a light emitter 53*a* and a light receiver 53*b* are provided on the opposite end portions of the image bearing member 1. The light emission output voltage of each of the sensors 53 is compared with the output value when the developer carrying member 15 initially bears against the dash member 51, whereby the quality of the opposed state of the image bearing member 1 and the developer carrying member 15 may be detected.

Instead of using the dash member 51, the output value when the image bearing member 1 and the developer carrying member 15 are kept in non-contact with each other and have a particular gap therebetween may be memorized and the pressure opposing operation of the developing cartridge may be controlled so that the output value from the sensor 53 may be the above-mentioned memorized output value, whereby the gap between the members 1 and 15 may be rendered into a particular set value. In that case, the developing cartridge D is directly moved by the cam 48, and provision is made of a member for pressing the developing cartridge in a direction backward from the image bearing member 1.

When the quality of the opposed state is to be detected, as shown in the block diagram of FIG. 21 and the flow chart of FIG. 22, after the termination of the switching operation for the developing cartridge, the pressing control motor is driven to start the pressing operation for the developing cartridge. If a signal enters from the SD sensor 201 (SD sensor 53) of FIG. 21 within a particular time t, the pressing control motor will be stopped to stop the pressing and the developing operation will be started. If there is no signal from the sensor within the time t, it will be displayed by an LED 205 and the developing cartridge selecting operation or the pressing operation will be performed again. When the gap is to be controlled, the moving operation of the developing cartridge is likewise stopped by the signal of the SD sensor 201, but the delay from the ON of the sensor till the stoppage may be compensated for by correcting the set value beforehand or by performing the operation of returning the developing cartridge by the amount of overrun after the developing cartridge is once stopped.

[Embodiment 6]

Figure 23:
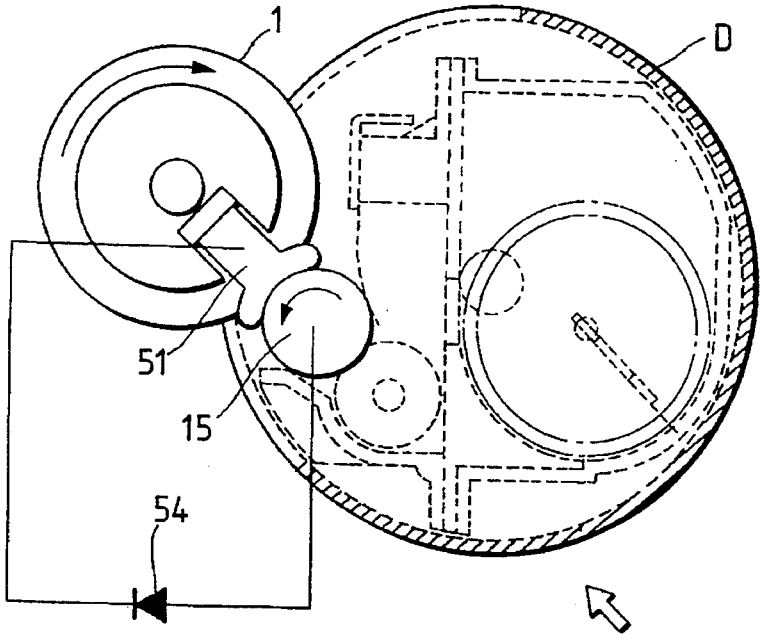
FIG. 23 is a front view showing a method of detecting the quantity of the opposition of the developer carrying member of the developing cartridge to an image bearing member by the pressurization at the developing position in still a further embodiment of the image forming apparatus of the present invention.

FIG. 23 shows a sixth embodiment of the present invention. In this embodiment, the dash member 51 for the gap is used as a conductive member and is connected to the developer carrying member 15 through a diode 54 so that the opposed state of the developer carrying member 15 and the image bearing member 1 may be detected from the presence or absence of the conduction by the contact between the dash member 51 and the developer carrying member 15. The dash member 51 is insulated relative to the image bearing member 1.

When conduction between the developer carrying member 15 and the image bearing member 1 is detected, the developing cartridge may be retracted by a predetermined amount from the conductive state as in the case of Embodiment 5, whereby the gap of the developer carrying member 15 relative to the image bearing member 1 may be controlled in non-contact.

[Embodiment 7]

Figure 24:
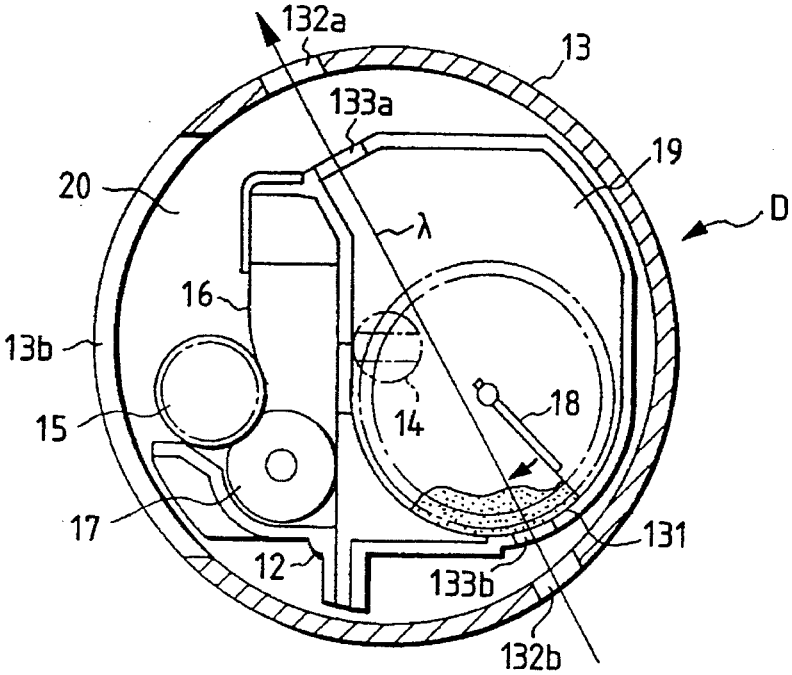
FIG. 24 is a cross-sectional view showing a developing cartridge in an embodiment of the polychromatic image forming apparatus of the present invention.
Figure 25:
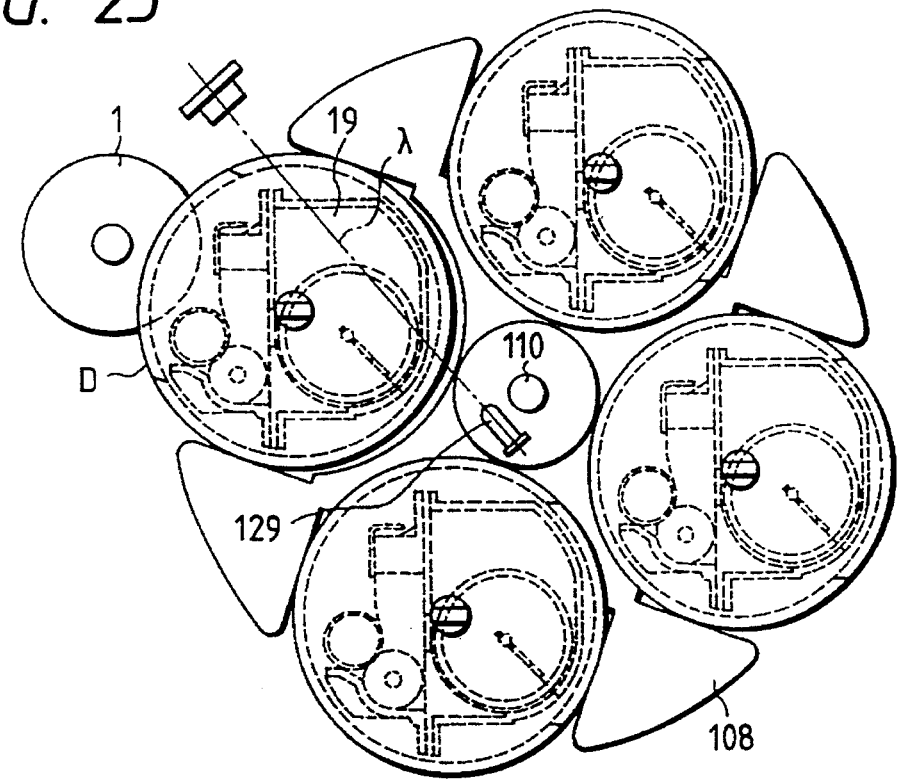
FIG. 25 is a front view showing a method of detecting the quantity of remaining developer in the developing cartridge in the image forming apparatus of FIG. 24.

FIG. 24 is a cross-sectional view showing a developing cartridge in an embodiment of the polychromatic image forming apparatus of the present invention, and FIG. 25 is a front view showing a method of detecting the quantity of remaining developer in the developing cartridge of FIG. 24.

As shown in FIG. 25, a light transmitting portion is formed in the developing cartridge D of each color so that when the cartridge D is moved to the developing position opposed to the image bearing member 1 by a rotary unit 108 and is pressed and positioned relative to the image bearing member 1, the developing cartridge D may have an optical path λ passing through the toner containing portion 19 in the developing device 12, on a straight line linking the center of rotation of the rotary unit 108 with the position outward of the position at which the rotary unit 108 embraces the developing cartridge D, as shown in FIG. 24.

That is, opening portions 132*a* and 132*b* are provided at two upper and lower locations in the shell 13 of the developing cartridge D of each color, and light transmitting windows 133*a* and 133*b* are formed at two upper and lower locations in the wall of the toner containing portion 19 of the developing device 12, and the opening portions 132*a* and 132*b* are disposed so that the opening portion 132*b*, the light transmitting window 133*b*, the light transmitting window 133*a* and the opening portion 132*a* may be rightly located on the optical path λ when the developing cartridge is positioned at the developing position.

At the center of rotation of the rotary unit 108, an LED 129 constituting one of means for detecting the quantity of remaining toner is fixedly provided on a member in the apparatus body, specifically, a semicylindrical member 123 surrounding the pressing control shaft 110 of FIG. 11 provided in the apparatus body, in such a manner as to be located on the optical path λ. At the position outward of the position at which the rotary unit embraces the developing cartridge D, a light receiving member 128 constituting the other of the means for detecting the quantity of the remaining toner and corresponding to the LED 129 is fixedly provided on a member, not shown, on the apparatus body side, in such a manner as to be likewise located on the optical path λ.

When the toner 131 in the toner containing portion 19 of the developing device 12 is in a position to cover the lower light transmitting window 33*b*, light emitted from the LED 129 is intercepted and not transmitted through the window 133*b*, but when the agitating-conveying member 18 driven with the driving of the developer carrying member 15 is rotated in the direction of arrow to sweep the toner 131 out of the light transmitting window 133*b*, the light from the LED 129 is transmitted through the transmitting window 133*b* and received by the light receiving member 128.

The length of the time for which this transmitted light is received by the light receiving member 128 will be short if the quantity of toner in the toner containing portion 19 is great, and will be long if the quantity of toner is small. Thus, the quantity of remaining toner in the toner containing portion 19 can be foreseen from the time for which the light is received by the light receiving member, and the quantity of remaining toner can be detected. Alternatively, the quantity of remaining toner may be foreseen from the integrated value of the light reception voltage in the light receiving member 128 and the quantity of remaining toner may be detected.

As described above, according to the present embodiment, the quantity of remaining toner in the developing cartridge of each color can be detected by the light transmitting system, without electrical parts such as an antenna member and a slidable contact for detecting the quantity of remaining toner being provided in the developing cartridge D of each color and without irregularity being caused among the developing cartridges of respective colors.

[Embodiment 8]

Figure 26:
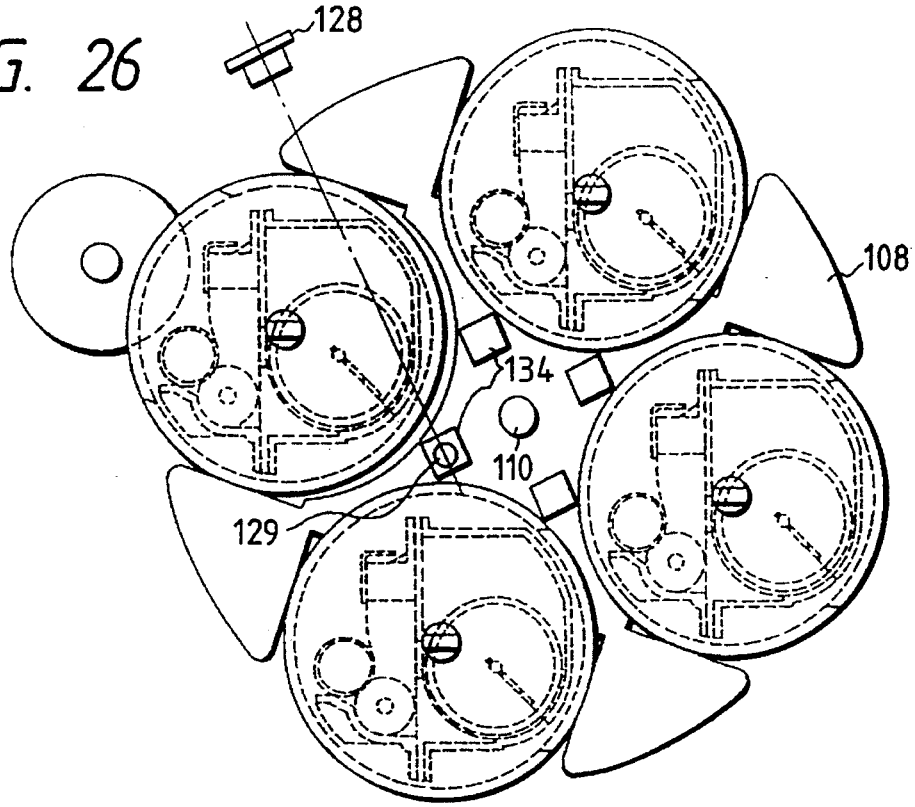
FIG. 26 is a front view showing a method of detecting the quantity of remaining developer in a developing cartridge in another embodiment of the image forming apparatus of the present invention.
Figure 27:
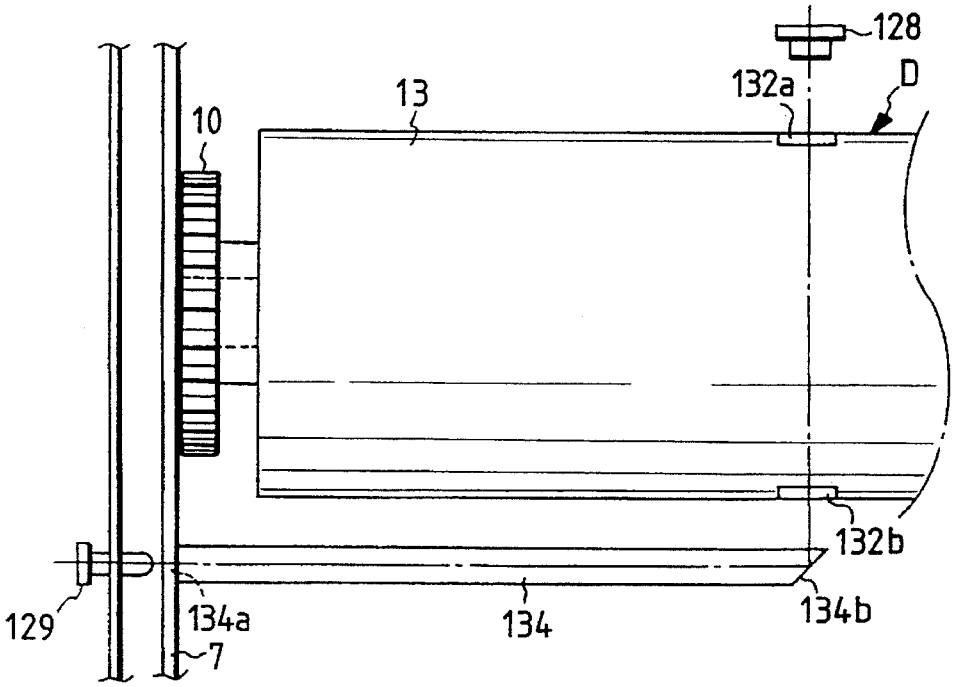
FIG. 27 is a cross-sectional view showing the detecting method of FIG. 26.

FIG. 26 is a front view showing a method of detecting the quantity of remaining developer in developing cartridges in another embodiment of the polychromatic image forming apparatus of the present invention, and FIG. 27 is a side view thereof.

This embodiment, as shown in FIGS. 26 and 27, is characterized in that light guide members 134 of acrylic resin extending through the central portion of the rotary unit 108 from the location of the driving side plate 7 at one end of the unit 108 to the central portion in the lengthwise direction of the developing cartridge D are provided correspondingly to the respective developing cartridges D, and an LED 129 is provided not at the center of rotation of the rotary unit 108 but on that side plate of the apparatus body which is adjacent to the driving side plate 7.

The light guide members 134 for the developing cartridge D of respective colors are disposed on the rotary unit 108 with a spacing of 90° provided in the circumferential direction thereof, and the LED 129 is disposed so as to correspond to the base end portion 134*a* of the light guide member 134 when the developing cartridge D is positioned at the developing position.

The tip end portion 134*b* of the light guide member 134 has its side which does not face the light receiving member 128 cut at 45°. The light emitted from the LED 129 enters the light guide member 134 at its base end portion 134*a* and is directed to the tip end portion 134*b*, at which the light is reflected by 90° and passes through the developing cartridge D and is received by the light receiving member 128.

Thus, without any electrical part being provided in the rotary unit 108, the quantity of remaining toner in each developing cartridge D can be detected, and the assembly property and maintenance property of the unit are improved.

In the above-described embodiment, the pressing control shaft 110 for pressing and positioning the developing cartridges D is provided at the center of rotation of the rotary unit 108 and therefore, any further modification of the detection of the quantity of remaining toner is impossible. But where the pressing mechanism for positioning does not use the center shaft 110 of the rotary unit 108 or where the developing cartridge pressing mechanism is not used for positioning, it is possible to detect the quantity of remaining toner by a construction in which a light guide member is provided at the center of rotation of the rotary unit 108.

While acrylic resin members are employed as the light guide members 134, use may also be made of glass members or optical fiber. Where optical fiber is used, a member for changing the optical path thereof is provided at the center of rotation of the rotary unit 108.

[Embodiment 9]

Figure 28:
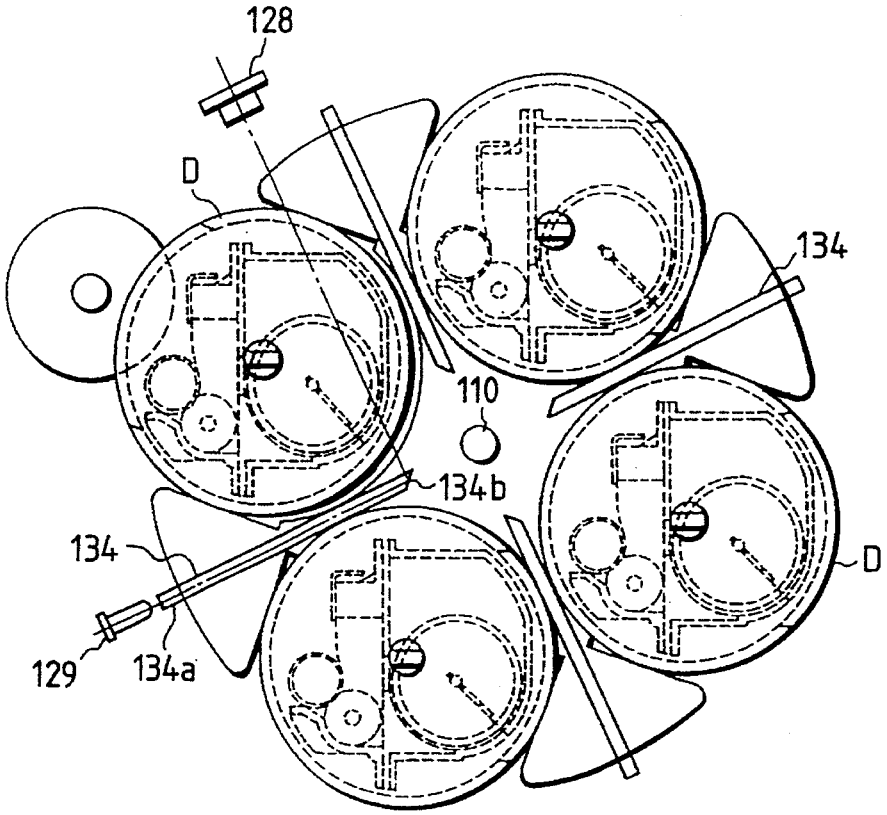
FIG. 28 is a front view showing a method of detecting the quantity of remaining developer in a developing cartridge in still another embodiment of the image forming apparatus of the present invention.

FIG. 28 is a front view showing a method of detecting the quantity of remaining developer in developing cartridges in still another embodiment of the polychromatic image forming apparatus of the present invention. This embodiment is characterized in that a light guide member 134 for the developing cartridge D of each color is provided on the rotary unit 108 in a direction perpendicular to the lengthwise direction of the developing cartridge D, i.e., in the radial direction of the rotary unit.

The light guide members 134 are disposed with a spacing of 90° provided in the circumferential direction of the rotary unit 108 and at locations corresponding to the locations between adjacent ones of the developing cartridges D. The base end portion 134*a* of each light guide member 134 is located outwardly of the outer edge portion of the rotary unit 108, and the tip end portion 134*b* of each light guide member 134 is located in the central portion of the unit 108. Likewise, an LED 129 is disposed so that when a developing cartridge D is positioned at the developing position, the LED may correspond to the base end portion 134*a* of the light guide member 134 for that developing cartridge.

Again by the present embodiment, without any electrical part being provided in the rotary unit 108, the quantity of remaining toner in each developing cartridge D can be detected and the assembly property and maintenance property of the unit are improved.

[Embodiment 10]

In the present embodiment, the means for detecting the quantity of remaining toner is used to detect the presence or absence of the mounting of the developing cartridges D onto the rotary unit 108.

Figure 29:
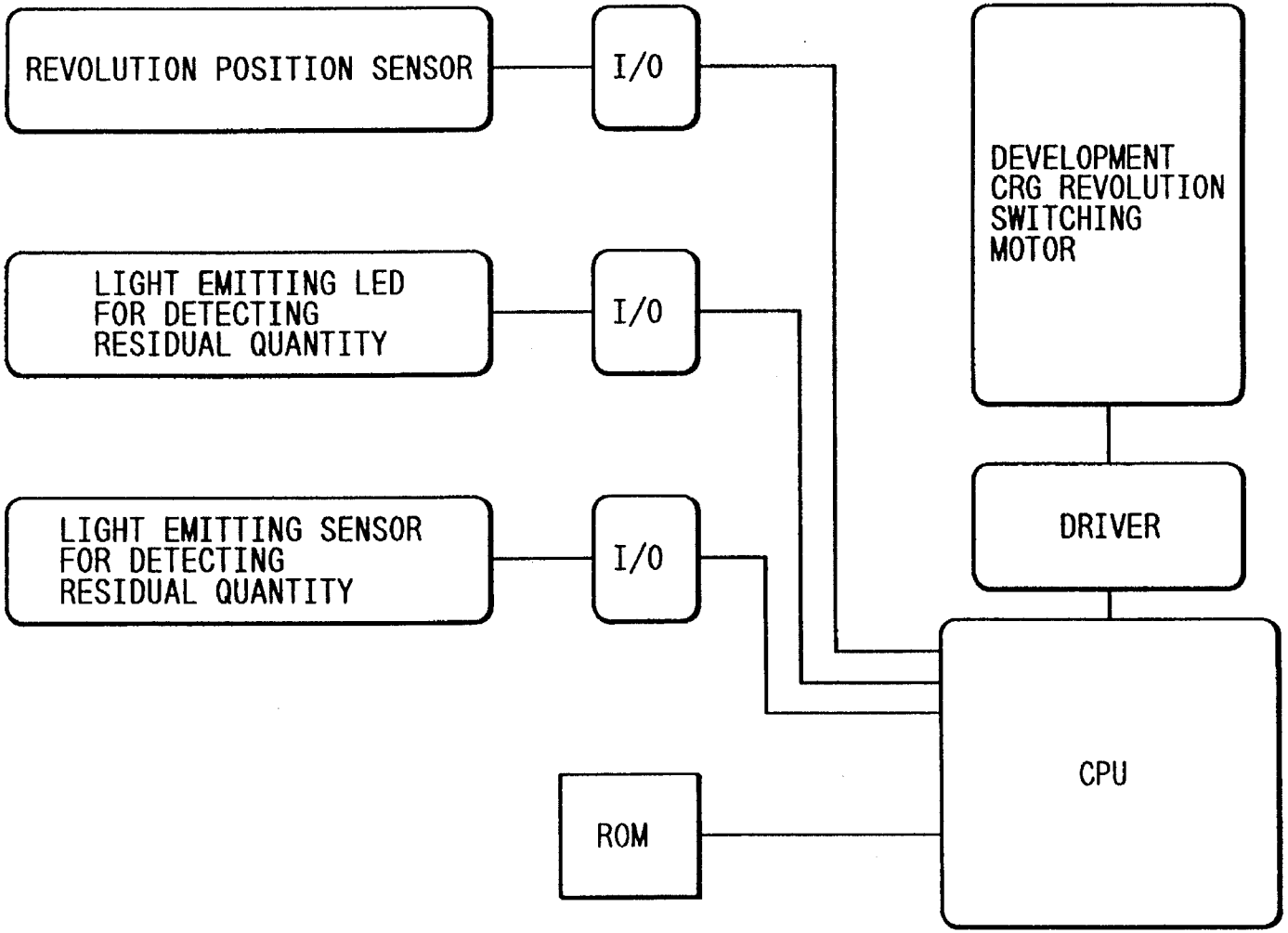
FIG. 29 is a block diagram showing a method of detecting the mounting of a developing cartridge on a rotary unit using means for detecting the quantity of remaining developer in yet still another embodiment of the image forming apparatus of the present invention.
Figure 30:
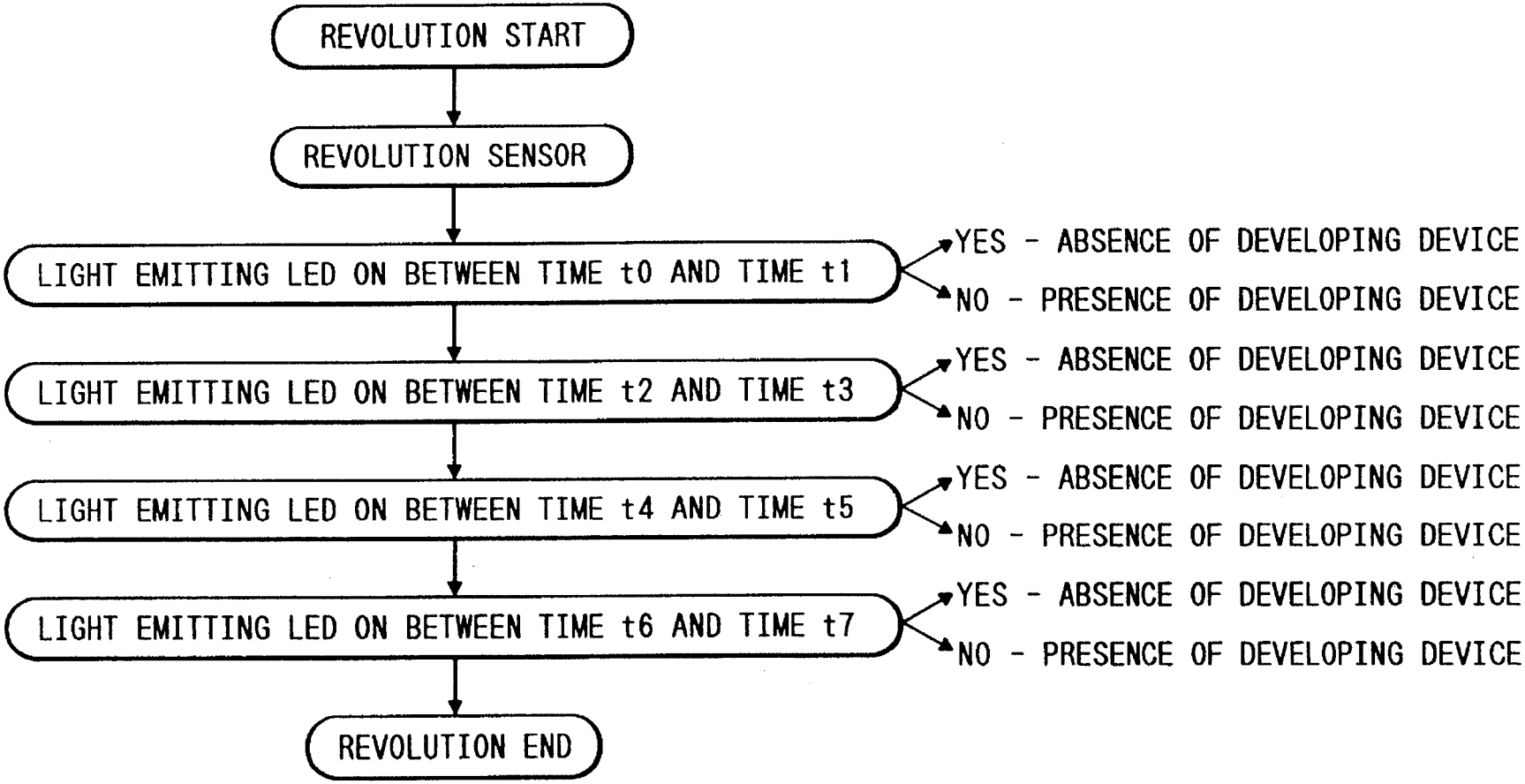
FIG. 30 is a flow chart showing the method of detecting the mounting of a developing cartridge.

FIG. 29 shows the then block diagram, and FIG. 30 shows the then flowchart.

For example, a revolution flag (not shown) is installed on the rotary unit 108, and a revolution position sensor (not shown) for detecting the rotation (revolution) position of the developing cartridge D about the center shaft 110 by the flag is installed on the apparatus body side.

A revolution switching motor for development CRG (developing cartridge D) is rotated by the CPU of FIG. 29, and the rotary unit 108 is driven to revolve the developing cartridges D. If the developing cartridges D are mounted on the rotary unit 108, at such a position that the light from the LED 129 will be intercepted and not received by the light receiving member 128, the means for detecting the quantity of remaining toner will be operated within a predetermined time with the signal of the revolution position sensor as the reference, i.e., within the time for which a developing cartridge is positioned at said position, as shown in FIG. 30.

Thus, whether a developing cartridge is mounted on the rotary unit 108 can be known from the presence or absence of ON (light reception) of the remaining quantity detecting sensor (light receiving member 128), and by this being repeated with respect also to the other developing cartridges as shown in FIG. 30, whether the developing cartridges are mounted at all mounting positions on the rotary unit 108 is detected.

While the present invention has been described above with respect to the illustrated embodiments thereof, the present invention is not restricted to these embodiments, but can be modified in any way within the technical idea thereof.

What is claimed is:

1. A developing apparatus comprising:

a rotatable developing unit having detachably mounted thereon a plurality of developing cartridges, said developing cartridges each having a containing portion for containing a developer therein and a carrying member for carrying the developer;

a light emitting element provided outside said developing unit and for irradiating light toward said developing unit;

a light receiving element provided outside said developing unit; and deflection members provided at said developing unit relative to each of said developing cartridges and outside of said developing cartridges for deflecting light having passed through said developing cartridge to direct the light to said light receiving element.

2. A developing apparatus according to claim 1, further comprising remaining quantity detecting means for detecting the quantity of remaining developer on the basis of the output of said light receiving element.

3. A developing apparatus according to claim 1, wherein said deflection members comprise light guide members provided for each of said developing cartridges.

4. A developing apparatus according to claim 1, wherein each of said developing cartridge has an entrance portion for causing the light from said light emitting element to enter said containing portion, and a transmitting portion transmitting the light therethrough.

5. A developing apparatus according to claim 1, wherein the detection of the quantity of remaining developer and the discrimination between the presence and absence of said developing cartridge are effected on the basis of the output of said light receiving element.

6. A developing apparatus according to claim 1, wherein said containing portion has therein an agitating member for agitating the developer, and the light from said light emitting element enters the agitating region by said agitating member.

7. A developing apparatus comprising:

a rotatable developing unit having a plurality of containing portions for detachably incorporating a developing cartridge;

a mounting detecting sensor for detecting the presence or absence of the mounting of said developing cartridge, said mounting detecting sensor being provided outside said developing unit; and driving means for causing said developing unit to rotate such that a containing portion to detect the presence or absence of the mounting of said developing cartridge is positioned at a detection position of said mounting detecting sensor.

8. A developing apparatus according to claim 7, wherein said mounting detecting sensor has a displaceable member biased toward said developing unit and urged by the developing cartridge mounted at said detecting position, and a detecting member for detecting the position of said displaceable member.

9. A developing apparatus according to claim 8, wherein said displaceable member is biased toward the rotary shaft of said developing unit.

* * * * *

UNITED STATES PATENT AND TRADEMARK OFFICE

CERTIFICATE OF CORRECTION

PATENT NO. : 5,617,188

DATED : April 1, 1997

INVENTOR(S) : Inomata, Mitsugu

It is certified that error appears in the above-identified patent and that said Letters Patent are hereby corrected as shown below:

Col. 10, line 60, delete "33b" and insert -- 133b --.

Signed and Sealed this

Second Day of June, 1998

*Attest:*

Bruce Lehman

BRUCE LEHMAN

*Attesting Officer*

*Commissioner of Patents and Trademarks*